US009329523B2

(12) United States Patent
Sakamaki

(10) Patent No.: US 9,329,523 B2
(45) Date of Patent: May 3, 2016

(54) DEVELOPING APPARATUS

(71) Applicant: CANON KABUSHIKI KAISHA, Tokyo (JP)

(72) Inventor: Tomoyuki Sakamaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/771,377

(22) Filed: Feb. 20, 2013

(65) Prior Publication Data

US 2013/0243489 A1 Sep. 19, 2013

(30) Foreign Application Priority Data

Mar. 15, 2012 (JP) ..... 2012-058902

(51) Int. Cl.
*G03G 15/08* (2006.01)
*G03G 15/09* (2006.01)

(52) U.S. Cl.
CPC ..... *G03G 15/0815* (2013.01); *G03G 15/0865* (2013.01); *G03G 15/0889* (2013.01); *G03G 15/0891* (2013.01); *G03G 15/0893* (2013.01); *G03G 15/09* (2013.01); *G03G 15/0921* (2013.01)

(58) Field of Classification Search
CPC ..... G03G 15/0815; G03G 15/0889; G03G 15/0891; G03G 15/0893; G03G 15/0921
USPC ..... 399/254, 256, 273, 277
See application file for complete search history.

(56) References Cited

U.S. PATENT DOCUMENTS 5,659,859 A * 8/1997 Kikuta et al. ..... 399/256
6,546,222 B2 4/2003 Sakemi et al.
6,850,722 B2 2/2005 Sakemi et al.
6,973,281 B2 12/2005 Hirobe et al.
6,975,825 B2 12/2005 Sakamaki et al.

(Continued)

FOREIGN PATENT DOCUMENTS

CN 101799654 A 8/2010
JP 5-333691 A 12/1993

(Continued)

OTHER PUBLICATIONS

Chinese Office Action dated Jan. 23, 2014, in related Chinese Patent Application No. 201310076898.6 (with English translation).

*Primary Examiner* — Benjamin Schmitt
(74) *Attorney, Agent, or Firm* — Fitzpatrick, Cella, Harper & Scinto

(57) ABSTRACT

A developing apparatus includes a developer carrying member configured to carry a developer including a toner and a carrier, a supply chamber provided opposite to a peripheral surface of the developer carrying member, and a collection chamber provided opposite to the peripheral surface of the developer carrying member. In addition, a first conveyance member is provided in the supply chamber, a second conveyance member is provided in the collection chamber, and a third conveyance member is provided opposite to the second conveyance member. The third conveyance member and the second conveyance member are directly opposed to each other in a predetermined position which overlaps with a developer carrying area of the developer carrying member, and the third conveyance member conveys a part of the developer conveyed by the second conveyance member in the predetermined position in the direction opposite to the second conveyance member.

3 Claims, 11 Drawing Sheets

(56) References Cited

U.S. PATENT DOCUMENTS

| | | | | |
|---|---|---|---|---|
| 6,978,108 | B2 | 12/2005 | Sakamaki | |
| 7,099,609 | B2 | 8/2006 | Hirobe et al. | |
| 7,231,154 | B2 | 6/2007 | Sakamaki | |
| 7,561,838 | B2 | 7/2009 | Sakamaki et al. | |
| 7,577,387 | B2 | 8/2009 | Suzuki | |
| 7,653,336 | B2 | 1/2010 | Akashi et al. | |
| 7,702,261 | B2 * | 4/2010 | Yasuda | 399/254 |
| 7,725,061 | B2 | 5/2010 | Sakamaki et al. | |
| 7,853,186 | B2 | 12/2010 | Akashi et al. | |
| 7,917,069 | B2 | 3/2011 | Sakamaki | |
| 7,991,332 | B2 | 8/2011 | Sakamaki | |
| 8,355,655 | B2 | 1/2013 | Sakamaki | |
| 8,571,449 | B2 | 10/2013 | Miyoshi et al. | |
| 8,750,752 | B2 | 6/2014 | Miyoshi et al. | |
| 2007/0280744 | A1 * | 12/2007 | Kubo et al. | 399/269 |
| 2012/0201577 | A1 | 8/2012 | Sakamaki et al. | |
| 2013/0136506 | A1 | 5/2013 | Sakamaki | |
| 2014/0233984 | A1 | 8/2014 | Miyoshi et al. | |

FOREIGN PATENT DOCUMENTS

| | | | | | |
|---|---|---|---|---|---|
| JP | 6-51634 | A | | 2/1994 | |
| JP | 11167260 | A | * | 6/1999 | G03G 15/08 |
| JP | 2000-066513 | A | | 3/2000 | |
| JP | 3127594 | B2 | | 1/2001 | |
| JP | 2001-290368 | A | | 10/2001 | |
| JP | 2001290368 | A | * | 10/2001 | G03G 15/08 |
| JP | 2007-033907 | A | | 2/2007 | |
| JP | 2011-095516 | A | | 5/2011 | |
| JP | 2011-242559 | A | | 12/2011 | |

* cited by examiner

DEVELOPING APPARATUS

BACKGROUND OF THE INVENTION

1. Field of the Invention

The present invention relates to a developing apparatus which forms a visible image by developing an electrostatic latent image formed on an image bearing member through an electrophotographic printing process or an electrostatic recording process. In particular, the present invention relates to an image forming apparatus such as a copier, a printer, a recorded image display apparatus, and a facsimile, the image forming apparatus including a developing apparatus which uses a dual-component developer including a toner and a carrier.

2. Description of the Related Art

Conventionally, an image forming apparatus employing an electrophotographic printing process or an electrostatic recording process, in particular, a color image forming apparatus configured to form a full color image by the electrophotographic printing process mostly includes a developing apparatus which uses a dual-component developer obtained by mixing a toner and a carrier in view of chromogenic properties and color blend properties.

As is well known, a developing method using the dual-component developer is a method of forming an image by electrically charging toner particles by triboelectric charging of carrier particles and the toner particles, and causing the electrically charged toner particles to electrostatically adhere to an electrostatic latent image. In such a dual-component developing process, in order to highly stably provide images while suppressing variation in density, it is important to stabilize a toner charge amount (hereinafter referred to as "triboelectricity"), and for this stabilization, it is necessary to equalize a toner density distribution in the developing apparatus. In general, the triboelectricity is liable to be influenced by a toner density, specifically, tends to increase in absolute value in accordance with a decrease of the toner density, and to decrease in absolute value in accordance with an increase of the toner density.

In view of this, in the conventional developing apparatus, when a toner is consumed along with development and the toner density of the developer decreases, a toner is replenished by an amount of compensating the consumed toner, and agitated. In this way, the toner density is controlled and maintained at a constant level.

However, along with use over a long period of time, at the time of development, in a state in which a toner is consumed, a developer collected from a developing sleeve to the developing apparatus may be resupplied to the developing sleeve at a partially non-uniform toner density without being sufficiently mixed with a developer in the developing apparatus. As a result, there arises a problem of the decrease of the toner density.

As a countermeasure for the problem described above, as described below, there has been proposed a structure in which, at the time of development, the developer reduced in toner density by consumption of a toner is prevented from being resupplied to the developing sleeve immediately after being collected in the developing apparatus. Specifically, there has been proposed a developing apparatus separately including a supply chamber configured to supply a developer to the developing sleeve and a collection chamber configured to collect the developer from the developing sleeve (Japanese Patent Application Laid-Open No. H05-333691). As illustrated in FIG. 11, this developing apparatus 101 includes a supply chamber 102 provided in an upper portion and a collection chamber 103 provided in a lower portion of the developing apparatus 101. The developing apparatus 101 further includes two upper and lower screws: a first conveying screw 104 and a second conveying screw 105, which are opposite to each other in a conveying direction, for circulating the developer between the collection chamber 103 and the supply chamber 102. While being circulated, the developer is supplied from the upper supply chamber 102 to a developing sleeve 106, and a photosensitive member 108 is subjected to development. Meanwhile, after completion of the development, the developer is collected from the developing sleeve 106 into the lower collection chamber 103. With this, the after-development developer reduced in toner density is not immediately resupplied to the developing sleeve 106. Thus, problems of partial non-uniformity in toner density and a decrease of the toner density are alleviated.

However, even with use of such a developing apparatus, the problems of partial non-uniformity in toner density, a decrease of the toner density, and the like have not yet been alleviated in a case where a toner consumption is large as in a case of forming an image of a high coverage rate.

In the collection chamber, a toner replenished in the developer and the developer collected from the developing sleeve are merged, and then agitated and conveyed. Thus, a level of the developer tends to be higher toward a downstream side in the conveying direction in the collection chamber. When the level of the developer becomes higher, the developer is conveyed to the supply chamber without being sufficiently agitated by the conveying (agitating) screw provided in the collection chamber. Thus, a part of the developer, which is collected in a region on the downstream side in the conveying direction in the collection chamber, is liable to be insufficiently agitated and mixed with another developer subjected to toner replenishment. Thus, those developers are liable to be transferred to the supply chamber without being mixed with each other. There is no problem in a case of forming an image of a low coverage rate. However, when the toner is insufficiently agitated in the case of forming an image of a high coverage rate, there remains a risk that the developer is transferred to the supply chamber without being equalized in density and the developer in uneven density may be supplied as it is to the developing sleeve.

As a countermeasure for the problem described above, there has been proposed a developing apparatus further including, in addition to the second conveying screw in the collection chamber, a third conveying screw configured to convey the developer in a direction opposite to that of the second conveying screw (Japanese Patent No. 3,127,594). As illustrated in FIG. 12, when a third conveying screw 107 is provided, a part of the developer, which stagnates on a rear side close to a communication portion through which the developer is transferred from the collection chamber 103 to the supply chamber 102, can be forced back in the direction opposite to the conveying direction of the second conveying screw 105. As a result, the level of the developer can be equalized, and an effect of agitating the dropped developer can be enhanced.

As in the structure of Japanese Patent No. 3,127,594, from a part of the developer, which stagnates in the communication portion between the collection chamber to the supply chamber (developing chamber), another part of the developer, which overflows on the third conveying screw side, can be forced back by the third conveying screw. As a result, it is possible to suppress rise of the level of the developer on the downstream side in the conveying direction, and the effect of equalizing the level of the developer can be obtained to some extent. However, as disclosed in Japanese Patent No. 3,127, 594, in the structure in which the level of the developer is merely equalized, a part of the developer reduced in toner density and collected in the collection chamber may be immediately conveyed to the communication portion communicating to the supply chamber without being sufficiently agitated. Thus, in order to solve the problems described above, the developer reduced in toner density and collected in the collection chamber needs to be effectively mixed with the developer subjected to toner replenishment before being conveyed to the communication portion communicating to the supply chamber.

SUMMARY OF THE INVENTION

In view of the problems described above, the present invention provides a developing apparatus capable of efficiently agitating a collected developer and a developer subjected to toner replenishment while suppressing the rise of the level of the developer on a downstream side in a developer conveying direction in a collection chamber configured to collect the developer from a developer carrying member.

In order to solve the above-mentioned problem, according to an embodiment of the present invention, there is provided a developing apparatus, comprising:

- a developer carrying member configured to carry a developer including a toner and a carrier;
- a magnet configured to cause the developer carrying member to carry the developer, the magnet including a plurality of magnetic poles having at least:
  - a first magnetic pole arranged on an inside of the developer carrying member; and
  - a second magnetic pole adjacent to the first magnetic pole on a downstream side in a rotation direction of the developer carrying member and having the same polarity as a polarity of the first magnetic pole;
- a supply chamber configured to supply the developer to the developer carrying member;
- a collection chamber of which both end portions are connected to the supply chamber, the collection chamber being configured to collect the developer used for development by the developer carrying member;
- a first conveyance member provided in the supply chamber and configured to convey the developer in the supply chamber;
- a second conveyance member provided in the collection chamber and configured to convey the developer in the collection chamber; and
- a third conveyance member provided opposite to the second conveying member to convey the developer in the collection chamber in a direction opposite to a developer conveying direction in the collection chamber, the third conveyance member having a spiral blade provided around a rotary shaft of the third conveyance member, wherein the third conveyance member is provided in a manner that a center of the rotary shaft of the third conveyance member is arranged below a zone and overlaps the zone in a gravity direction, the zone being defined on a surface of the developer carrying member between a position of a local maximal peak of a component, in a normal direction of the developer carrying member, of a magnetic flux density of the first magnetic pole and a position of a local minimal peak of the component, in the normal direction of the developer carrying member, of the magnetic flux density, the position of the local minimal peak being located immediately downstream of the position of the local maximal peak in the rotation direction of the developer carrying member.

Further features of the present invention will become apparent from the following description of exemplary embodiments with reference to the attached drawings.

DESCRIPTION OF THE EMBODIMENTS

Figure 1:
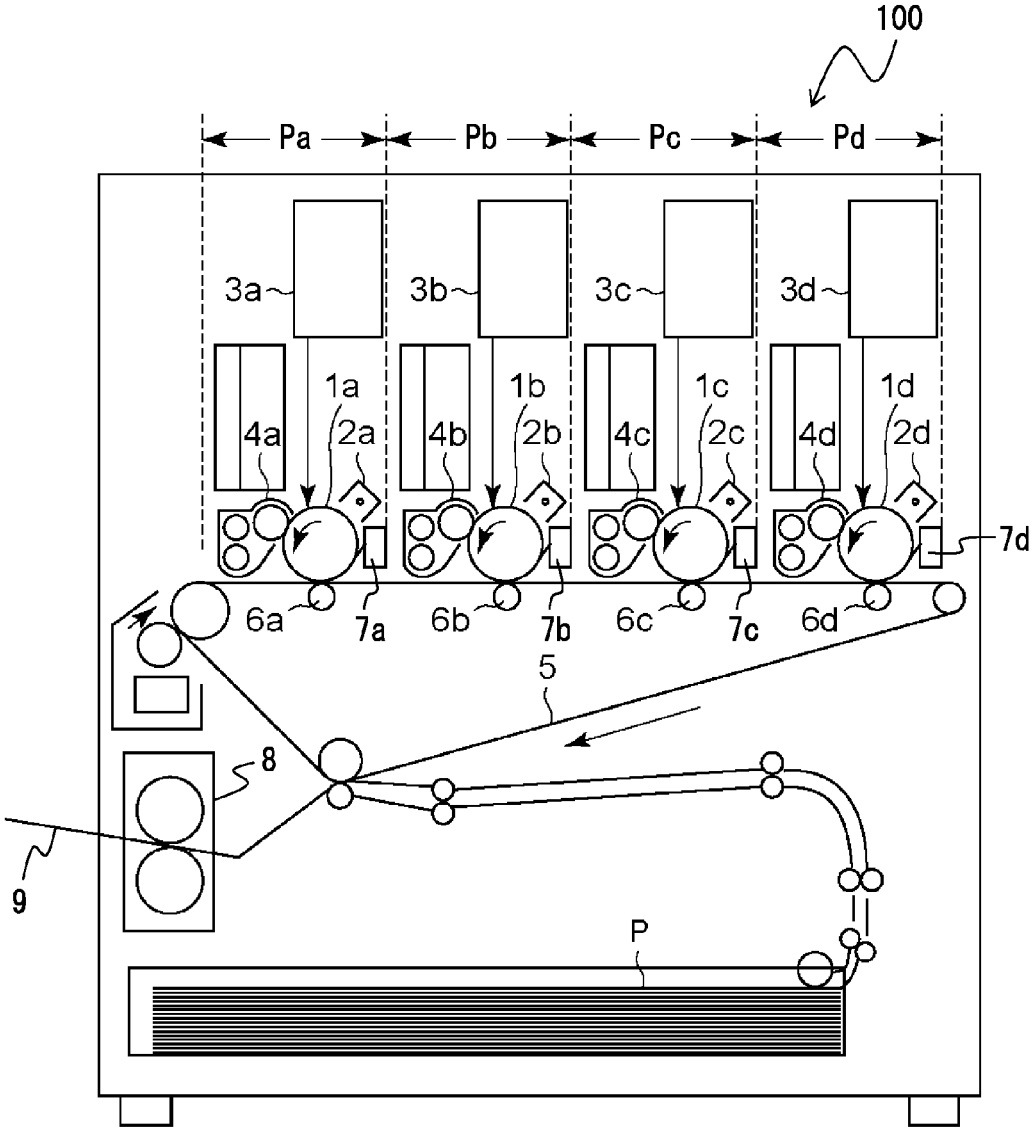
FIG. 1 is an explanatory diagram of a structure of an image forming apparatus.

In the following, embodiments of the present invention will be described in detail with reference to the drawings. In those embodiments, a substantial part for toner image formation will be only described. By being provided with necessary devices, equipment, and chassis structures, the present invention can be used for various applications such as a printer, various printing machines, a copier, a facsimile, and a multifunction peripheral.

Note that, general matters of the image forming apparatus disclosed in Japanese Patent Application Laid-Open No. H05-333691 and Japanese Patent No. 3,127,594 (which are incorporated herein by reference) are not shown in the drawings, and redundant description thereof is omitted.

(Embodiment 1)

(Image Forming Apparatus)

Figure 2:
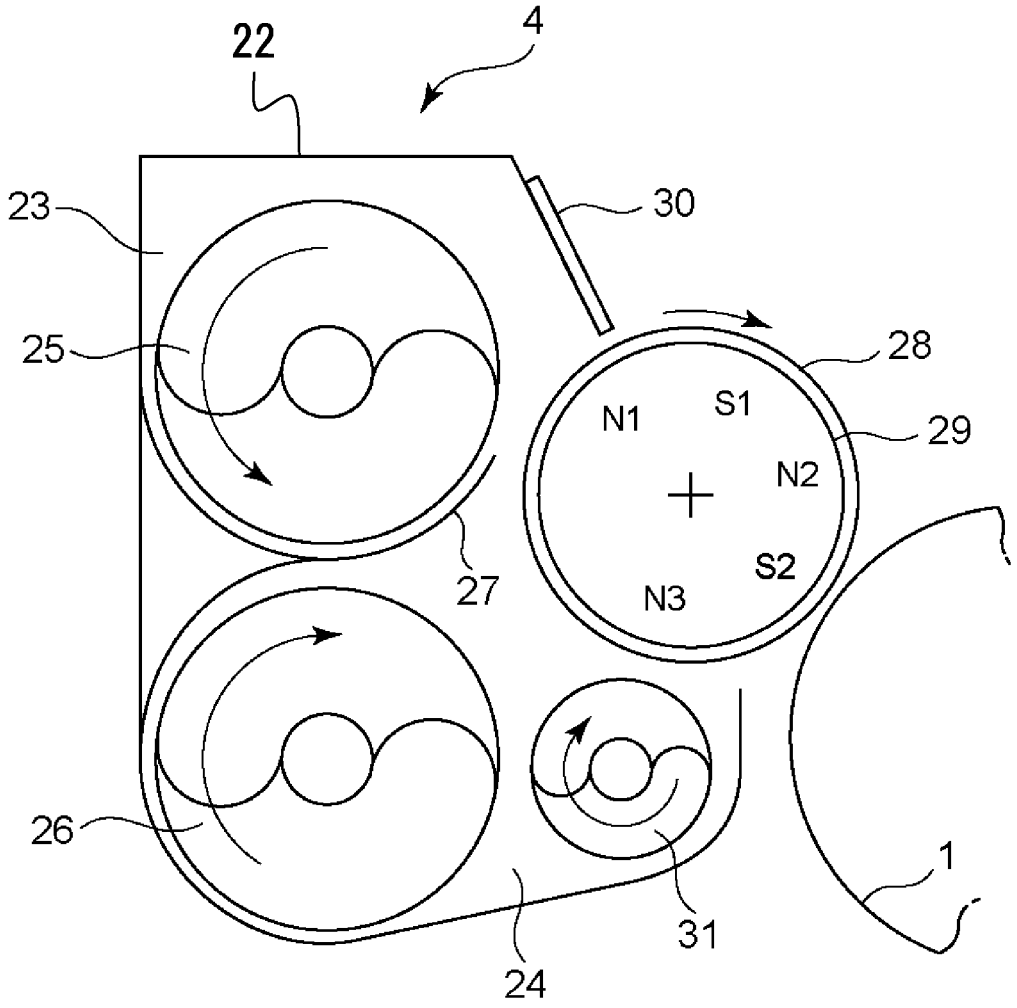
FIG. 2 is an explanatory diagram of a developing apparatus.
Figure 3:
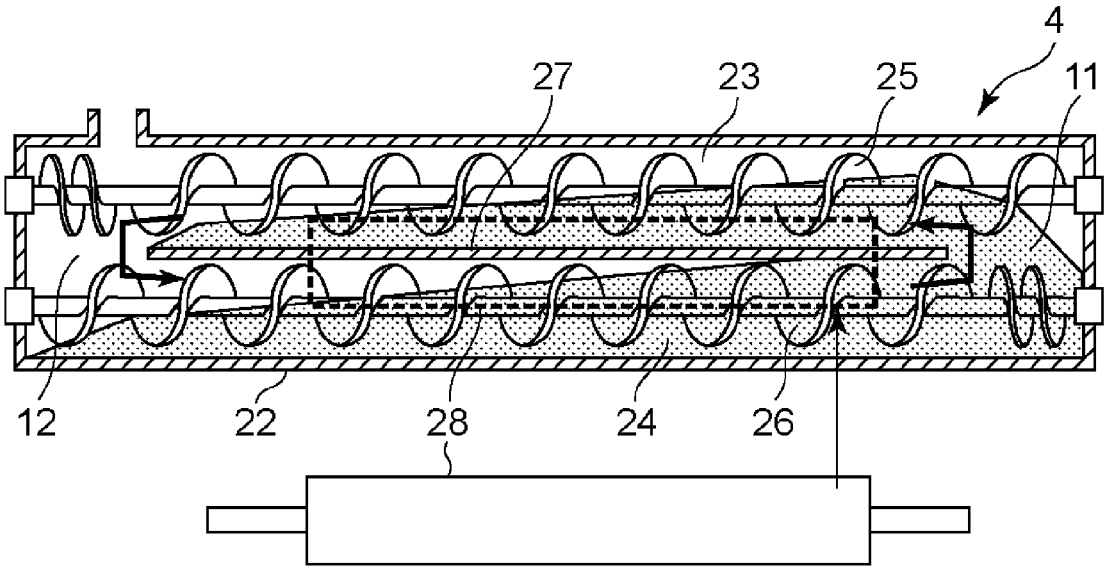
FIG. 3 is an explanatory diagram of the developing apparatus.

FIG. 1 is an explanatory diagram of a structure of an image forming apparatus. FIGS. 2 and 3 are explanatory diagrams of a developing apparatus.

As illustrated in FIG. 1, an image forming apparatus 100 is a full-color printer of a tandem intermediate transfer type, including image forming portions Pa, Pb, Pc, and Pd of yellow, magenta, cyan, and black arranged along an intermediate transfer belt 5. A plurality of image forming portions are arranged along an intermediate transfer medium.

In the image forming portion Pa, a yellow toner image is formed on a photosensitive drum 1*a* and is then primarily transferred to the intermediate transfer belt 5. In the image forming portion Pb, a magenta toner image is formed on a photosensitive drum 1*b* and is then primarily transferred in a superimposed manner onto the yellow toner image of the intermediate transfer belt 5. In the image forming portions Pc and Pd, a cyan toner image and a black toner image are formed on photosensitive drums 1*c* and 1*d*, respectively, and are also primarily transferred sequentially onto the intermediate transfer belt 5 in a superimposed manner.

A four-color toner image primarily transferred onto the intermediate transfer belt 5 is conveyed to a secondary transfer portion and secondarily transferred onto a recording material P in a collective manner. The recording material P on which the four-color toner image has been secondarily transferred is heated and pressurized by a fixing device 8 to have the toner image fixed to a surface thereof, and is then delivered to a stacking tray 9.

The image forming portions Pa, Pb, Pc, and Pd have substantially the same structure except that colors of toner used for developing electrostatic latent images are different among yellow, magenta, cyan, and black. In the following, the image forming portion Pa will be described, and the other image forming portions Pb, Pc, and Pd will be described by replacing the suffix of the reference symbol "a" in the description with "b", "c", and "d".

The image forming portion Pa includes the photosensitive drum 1*a*, and a corona charger 2*a*, an exposure device 3*a*, a developing apparatus 4*a*, a primary transfer roller 6*a*, and a cleaning device 7*a*, which are arranged around the photosensitive drum 1*a*.

The photosensitive drum 1*a* has a photosensitive layer having a negative charge polarity, which is formed on an outer peripheral surface of an aluminum cylinder, and rotates in a direction indicated by the arrow at a process speed of 300 mm/sec. The corona charger 2*a* irradiates the photosensitive drum 1*a* with charged particles along with corona discharge to charge a surface of the photosensitive drum 1*a* uniformity to have a negative potential. The exposure device 3*a* scans, by using a rotating mirror, a laser beam subjected to ON-OFF keying in accordance with scanning line image data obtained by developing a yellow separated color image, and writes an electrostatic latent image of the image onto the charged surface of the photosensitive drum 1*a*.

The developing apparatus 4*a* agitates a dual-component developer including a magnetic carrier and a non-magnetic toner as main components so as to charge the magnetic carrier and the non-magnetic toner to have a positive polarity and a negative polarity, respectively. The dual-component developer thus charged is rubbed against the photosensitive drum 1*a* by being carried by a developing sleeve 28 rotated about a fixed magnetic pole. Then, an oscillating voltage generated by superimposing an alternating voltage on a negative direct-current voltage is applied to the developing sleeve 28. With this, the non-magnetic toner charged to have a negative polarity is transferred onto the electrostatic latent image on the photosensitive drum 1*a* charged to have a positive polarity relative to the developing sleeve 28. Then, the electrostatic latent image is subjected to reverse development.

The primary transfer roller 6*a* presses the intermediate transfer belt 5 so as to form a primary transfer portion between the photosensitive drum 1*a* and the intermediate transfer belt 5. A positive direct-current voltage is applied to the primary transfer roller 6*a*, to thereby primarily transfer the negative toner image borne on the photosensitive drum 1*a* onto the intermediate transfer belt 5 to pass through the primary transfer portion.

The cleaning device 7*a* rubs a cleaning blade thereof against the photosensitive drum 1*a* so as to collect untransferred residual toner remaining on the photosensitive drum 1*a* without being subjected to primary transfer onto the intermediate transfer belt 5. A transfer belt cleaning device 10 collects untransferred residual toner remaining on the intermediate transfer belt 5 without being subjected to secondary transfer onto the recording material P.

(Developing Apparatus)

As illustrated in FIGS. 2 and 3, the developing apparatus 4 includes a developing container 22, and the developing container 22 contains, as a developer, the dual-component developer including the magnetic carrier and the non-magnetic toner. Further, the developing container 22 includes the developing sleeve 28 as a developer carrying member and a magnetic brush trimming member 30 configured to regulate a magnetic brush of the developer carried on the developing sleeve 28.

In this embodiment, the developing container 22 is provided with an opening portion formed at a position corresponding to a developing region opposite to the photosensitive drum 1, and the developing sleeve 28 is arranged to be rotatable in a manner that the developing sleeve 28 is partially exposed from the opening portion in a direction of the photosensitive drum 1.

The developing sleeve 28 has a diameter of 20 mm, and the photosensitive drum 1 has a diameter of 80 mm. Further, in a region in which the developing sleeve 28 and the photosensitive drum 1 come closest to each other, a clearance of approximately 300 μm is secured therebetween. With this setting, development can be performed in a state in which the developer conveyed to a developing portion is held in contact with the photosensitive drum 1. Note that, the developing sleeve 28 is made of a non-magnetic material such as aluminum and stainless steel, and a magnet roller 29 as a magnetic field generating unit is installed on an inside thereof under an unrotatable state. The magnet roller 29 includes a development pole S2 arranged opposite to the photosensitive drum 1 in the developing portion, and further includes a regulating magnetic pole N1 arranged opposite to the magnetic brush trimming member 30, magnetic poles S1 and N2 arranged between the regulating magnetic pole N1 and the development pole S2, and a stripping magnetic pole N3 arranged opposite to a collection chamber 24.

The developing sleeve 28 is rotated in the arrow direction (clockwise direction) indicated in FIG. 2 at the time of development so as to carry and convey the dual-component developer subjected to layer thickness regulation through magnetic brush trimming by the magnetic brush trimming member 30 into the developing region opposite to the photosensitive drum 1.

The magnetic brush trimming member 30 (regulating blade) is formed of a non-magnetic member such as an aluminum plate extended along an axis in a longitudinal direction of the developing sleeve 28, and is arranged on an upstream side in a rotation direction of the developing sleeve 28 with respect to the photosensitive drum 1. Through a clearance between an edge portion of the magnetic brush trimming member 30 and the developing sleeve 28, both the toner and the carrier of the developer are sent to the developing region. Note that, through adjustment of the clearance between the magnetic brush trimming member 30 and a surface of the developing sleeve 28, a trimming amount of the magnetic brush of the developer carried on the developing sleeve 28 is regulated. As a result, an amount of the developer to be conveyed into the developing region is adjusted. In this embodiment, a developer coating amount per unit area on the developing sleeve 28 is regulated to 30 mg/cm$^2$ with the magnetic brush trimming member 30.

The dual-component developer on the developing sleeve 28 is conveyed into the developing region opposing the photosensitive drum 1 along with rotation of the developing sleeve 28. Then, the electrostatic latent image formed on the photosensitive drum 1 is developed into a toner image with the toner included in the dual-component developer. At this time, in order to enhance a developing efficiency, in other words, a toner applying rate with respect to the electrostatic latent image, a developing bias voltage generated by superimposing a direct-current voltage and an alternating-current voltage on each other is applied from a power source to the developing sleeve 28.

In this embodiment, a direct-current voltage of −500 V, a peak-to-peak voltage Vpp of 1,500 V, and an alternating-current voltage having a frequency "f" of 12 kHz are applied.

An inside of the developing container 22 is divided by a partition wall 27 extending at a substantially central portion thereof in a direction perpendicular to the drawing sheet of FIG. 2 into a supply chamber 23 and the collection chamber 24. The developer is contained in the supply chamber 23 and the collection chamber 24.

In the supply chamber 23 and the collection chamber 24, there are respectively arranged a first conveying screw 25 and a second conveying screw 26 each serving as a developer agitating and conveying unit. The first conveying screw 25 as a first conveyance member is arranged substantially parallel to an axial direction of the developing sleeve 28, and is rotated in the arrow direction (counterclockwise direction) indicated in FIG. 2 so as to convey the developer in the supply chamber 23 to one side along the axial direction. Further, the second conveying screw 26 as a second conveyance member is arranged substantially parallel to the first conveying screw 25 in the collection chamber 24, and is rotated in a direction reverse to that of the first conveying screw 25 (clockwise direction) so as to convey the developer in the collection chamber 24 to a side opposite to the side on which the first conveying screw 25 conveys the developer. In this way, through conveyance by rotations of the first conveying screw 25 and the second conveying screw 26, the developer is circulated between the supply chamber 23 and the collection chamber 24 via opening portions (in other words, communication portions) 11 and 12 at both end portions of the partition wall 27.

The collection chamber 24 further includes a third conveying screw 31 as a third conveyance member arranged to be adjacent substantially in parallel to the second conveying screw 26. The third conveying screw 31 conveys, while being rotated, the developer to the side opposite to the side on which the second conveying screw 26 conveys the developer. The first conveying screw 25, the second conveying screw 26, and the third conveying screw 31 each include a screw member including a spiral blade provided about a rotary shaft thereof.

However, as described in "Description of the Related Art," only by disposition of the third conveying screw 31, the developer reduced in toner density and collected in the collection chamber 24 is not necessarily prevented from being immediately conveyed to the communication portion 11 communicating to the supply chamber 23. This is because, when the third conveying screw 31 is configured only to force back the developer in the collection chamber 24 to the side opposite to the conveying direction as in the conventional structures, the developer reduced in toner density and dropped from the developing sleeve 28 is not necessarily conveyed by the third conveying screw 31 to the opposite side.

In order to solve the above-mentioned problem, it is necessary that the third conveying screw 31 be configured to agitate and convey the developer reduced in toner density and dropped from the developing sleeve 28 with a higher priority.

In view of this, the present invention has a feature in that the developer reduced in toner density and dropped from the developing sleeve 28 is accurately guided onto the third conveying screw 31, to thereby agitate and convey the developer reduced in toner density with a high priority by the third conveying screw 31. In the following, detailed description of this configuration will be provided with reference to FIGS. 4A and 4B.

A position at which the developer drops from the developing sleeve 28 is determined by a pattern of the magnet roller 29 inside the developing sleeve 28. Thus, when the magnet pattern of the magnet roller 29 is appropriately set, the developer dropped from the developing sleeve 28 can be accurately guided onto the third conveying screw 31.

Figure 4A:
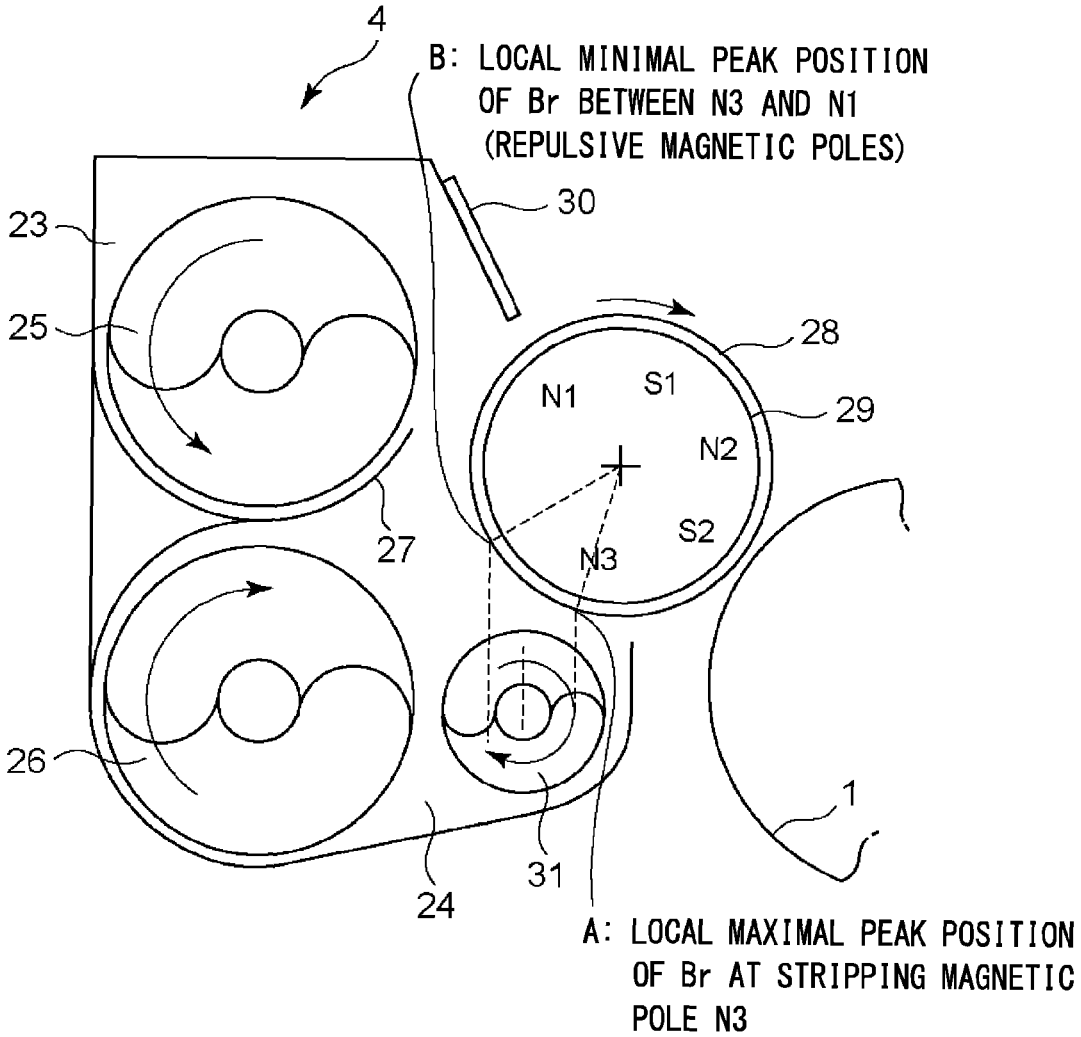
FIG. 4A is an enlarged view of a vicinity of a developing sleeve of the developing apparatus according to the embodiment.

As illustrated in FIG. 4A, the magnet roller 29 includes the stripping magnetic pole N3 arranged on a downstream side in the rotation direction of the developing sleeve 28 with respect to the development pole S2. Further, on the downstream side with respect to the stripping magnetic pole N3, the regulating magnetic pole N1 having the same polarity as that of the stripping magnetic pole N3 is arranged to generate a repulsive magnetic field. In other words, in the rotation direction of the developing sleeve 28, the stripping magnetic pole N3 as a first magnetic pole and the regulating magnetic pole N1 as a second magnetic pole, which commonly have the same polarity, cooperatively generate the repulsive magnetic field.

Figure 4B:
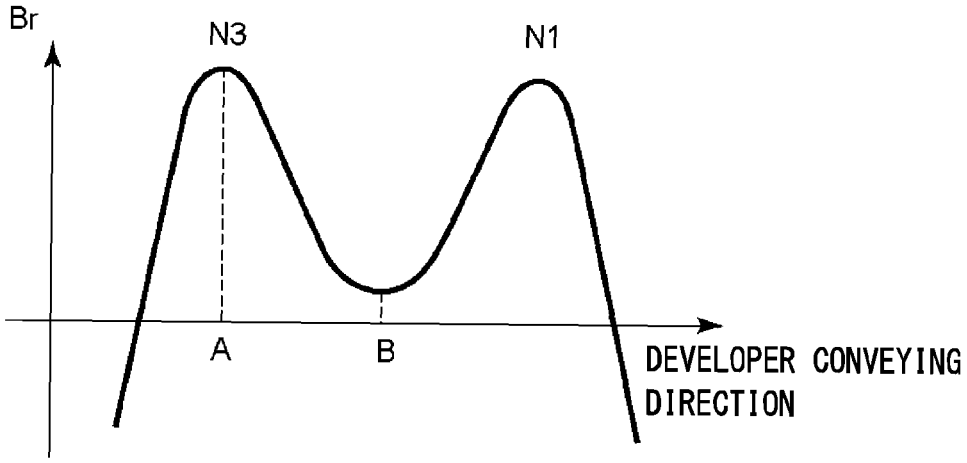
FIG. 4B is a graph showing a distribution of a magnetic flux density.

The developer reduced in toner density by being used for development at the time of passing by the development pole S2 is conveyed to the stripping magnetic pole N3 along with the rotation of the developing sleeve 28. As described above, the stripping magnetic pole N3 and the regulating magnetic pole N1 are adjacent to each other, and hence the repulsive magnetic field is generated therebetween. As a result, a magnetic flux density between the stripping magnetic pole N3 and the regulating magnetic pole N1 is reduced approximately to 0 mT. FIG. 4B shows a distribution of an "r" component Br of a magnetic flux density between the stripping magnetic pole N3 and the regulating magnetic pole N1. As the "r" component Br of the magnetic flux density (component in a normal direction of the developing sleeve 28) decreases, a force of attracting the carrier included in the developer toward the developing sleeve 28 decreases. Thus, the developer including the carrier starts to drop approximately at a timing of passing a peak position (position of local maximal peak (A)) of the "r" component Br of the magnetic flux density at the stripping magnetic pole N3 (component in the normal direction of the developing sleeve 28). Also from then on, as the magnetic flux density becomes lower, the developer continues to drop, and almost all the developer drops before reaching a position of a local minimal peak (B) of the "r" component Br of the magnetic flux density between the stripping magnetic pole N3 and the regulating magnetic pole N1. The repulsive magnetic field is generated on the downstream side with respect to the stripping magnetic pole N3, and hence both the "r" component Br and a θ component Bθ of the magnetic flux density decrease. In addition, an absolute value of the magnetic flux density $|B|=(Br^2+B\theta^2)^{1/2}$ decreases in accordance with the "r" component Br. In general, a magnetic force is generated in accordance with a variation (gradient) of the absolute value |B| of the magnetic flux density, specifically, generated from a point at which the absolute value |B| is small toward a point at which the absolute value |B| is large. The absolute value |B| continues to decrease until the local minimal peak (B) of the component Br, and hence a magnetic force Fθ(proportional to ∂|B|∂θ) in a tangential direction on the developing sleeve 28 acts in a direction reverse to the rotation direction of the developing sleeve 28. Therefore, between the local maximal peak (A) of the "r" component Br of the magnetic flux density at the stripping magnetic pole N3 and the local minimal peak (B) of the "r" component Br, the magnetic force continues to act in the direction reverse to the rotation direction of the developing sleeve 28. Meanwhile, this magnetic force acts as a brake on the conveyance of the developer, and hence a conveying speed of the developer gradually decreases. In this region, as the "r" component Br decreases, the force of attracting the carrier toward the developing sleeve 28 gradually decreases. Thus, synergistically with the decrease of the conveying speed, between the local maximal peak (A) of the "r" component Br of the magnetic flux density at the stripping magnetic pole N3 and the local minimal peak (B) of the "r" component Br, the developer drops by gravity substantially straightly in a downward direction.

In this embodiment, in order to further suppress non-uniformity of the toner density of the developer dropped from the developing sleeve 28, the following configuration is employed. In the present invention, the third conveying screw 31 is arranged immediately on a lower side in the gravity direction with respect to a zone between the local maximal peak (A) of the "r" component Br of the magnetic flux density at the stripping magnetic pole N3 and the local minimal peak (B) of the "r" component Br between the repulsive magnetic poles. In this case, in this embodiment, as illustrated in FIG. 4A, the third conveying screw 31 is arranged in a manner that an axial center thereof is located between a position immediately below, in the gravity direction, the local maximal peak (A) of the "r" component Br of the magnetic flux density at the stripping magnetic pole N3 and a position immediately below, in the gravity direction, the local minimal peak (B) of the "r" component Br between the repulsive magnetic poles.

With this arrangement, even when the collected developer locally includes a region in which the toner density is low, the developer can be dropped in advance in a distributed manner into both sides with respect to the axial center of the third conveying screw 31. Specifically, after being separated into both the sides with respect to the axis, the developer is more effectively dispersed by being subjected to an agitation action of a blade of the third conveying screw 31, and hence can be transferred to the second conveying screw 26 in a sufficiently dispersed state. In this way, the developer dropped from the developing sleeve 28 can be more effectively agitated in comparison with a case where the developer is dropped to only any one of sides with respect to the axial center of the third conveying screw 31. As a result, the developer reduced in toner density and collected in the collection chamber 24 is prevented from being immediately conveyed to the communication portion 11 communicating to the supply chamber 23, and the non-uniformity of the toner density can be eliminated.

Further, in this embodiment, as illustrated in FIG. 4A, the third conveying screw 31 is arranged in a manner that the entire zone between the local maximal peak (A) of the "r" component Br at the stripping magnetic pole N3 and the local minimal peak (B) of the "r" component Br between the repulsive magnetic poles falls within a range corresponding to an outer diameter of the third conveying screw 31. With this, almost all the developer reduced in toner density through the developing portion can be dropped onto the third conveying screw 31. As a result, the developer dropped from the developing sleeve 28 is conveyed in the direction opposite to that of the second conveying screw 26 with a higher priority by the third conveying screw 31, and hence the developer reduced in toner density can be prevented from being immediately conveyed to the communication portion 11 communicating to the supply chamber 23.

Figure 5:
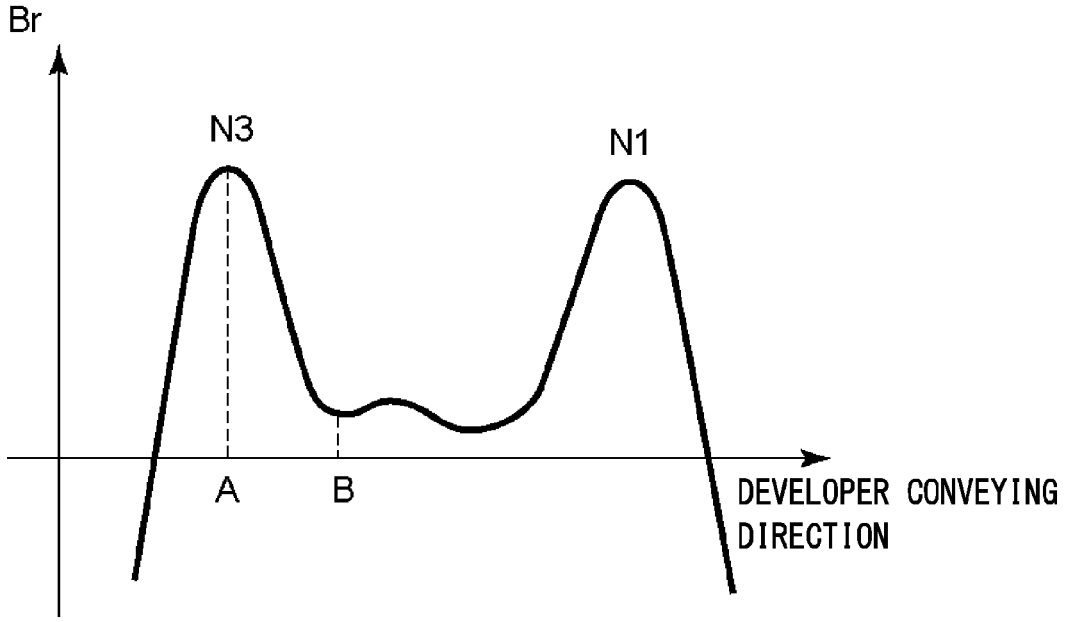
FIG. 5 is a graph showing a distribution of the magnetic flux density for explaining the developing apparatus according to the embodiment.
Figure 6:
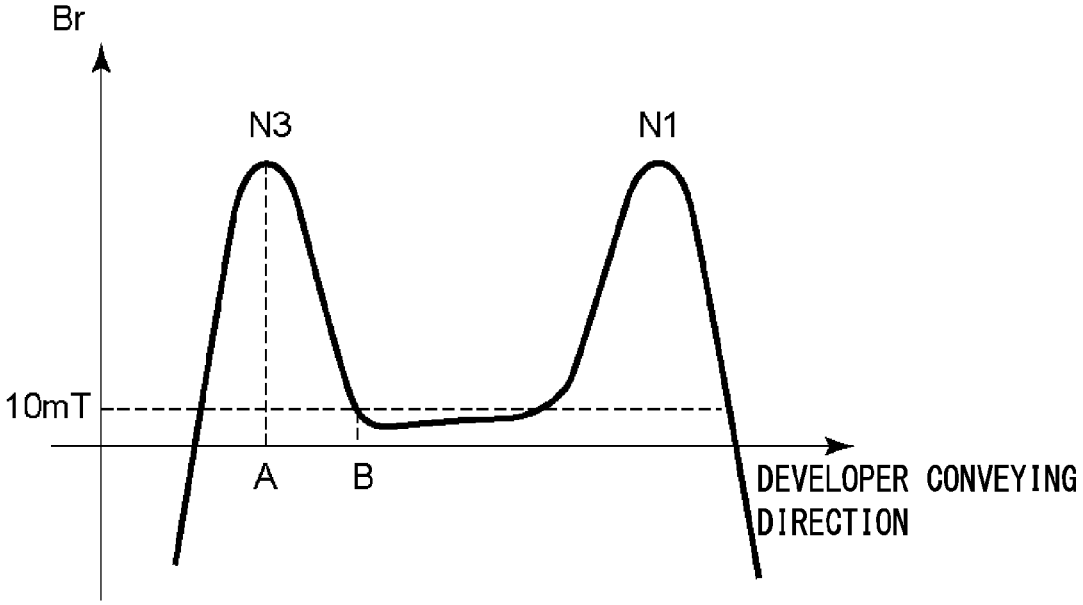
FIG. 6 is a graph showing a distribution of the magnetic flux density for explaining the developing apparatus according to the embodiment.

Note that, the "local minimal peak" herein refers to a local minimal point of the "r" component Br between the stripping magnetic pole N3 and the regulating magnetic pole N1 arranged on the downstream side with respect to the stripping magnetic pole N3 and having the same polarity as that of the stripping magnetic pole N3. When the local minimal point includes only one local minimal point, the position of the one local minimal point may be determined as the position of the local minimal peak. However, when the local minimal point includes two or more local minimal points, a local minimal point closest to the stripping magnetic pole N3, in other words, a local minimal point immediately on the downstream side with respect to the stripping magnetic pole N3 (FIG. 5) is determined as the local minimal peak. This is because stripping off of the developer is substantially completed at a first local minimal point which the developer reaches after passing by the stripping magnetic pole N3. Meanwhile, in some cases, a region in which the "r" component Br of the magnetic flux density is markedly small at a position on the surface of the developing sleeve 28 is formed over a wide range on the surface of the developing sleeve 28. In such a case, the local minimal point is ambiguous. In such a case, in a region between the stripping magnetic pole N3 and the regulating magnetic pole N1, in which the "r" component Br of the magnetic flux density at the position on the surface of the developing sleeve 28 is equal to or less than 10 mT, a position closest to the stripping magnetic pole N3 may be specified as the local minimal peak (FIG. 6). This is because, in the region in which the "r" component Br of the magnetic flux density is small, specifically, equal to or less than 10 mT, the magnetic force to be applied to each carrier particle is markedly small, and hence, also in consideration of an action of the gravity, stripping off of the developer is substantially completed.

Note that, in the case described above, both the position of the local maximal peak (A) of the "r" component Br at the stripping magnetic pole N3 and the position of the local minimal peak (B) of the "r" component Br on the downstream side with respect to the position of the local maximal peak (A) are set to be lower in the gravity direction than a height position of the axial center of the developing sleeve 28. Of those positions, it is necessary to set the position of the local maximal peak (A) of the "r" component Br at the stripping magnetic pole N3 to be lower in the gravity direction than the height position of the axial center of the developing sleeve 28. Meanwhile, the position of the local minimal peak (B) of the "r" component Br on the downstream side with respect to the position of the local maximal peak (A) may be set to be higher in the gravity direction than the height position of the axial center of the developing sleeve 28. In this case, even when a force of holding the developer decreases between the position of the local maximal peak (A) of the "r" component Br at the stripping magnetic pole N3 and the position of the local minimal peak (B) of the "r" component Br on the downstream side with respect to the position of the local maximal peak (A), the developer is prevented from dropping because a part of the developing sleeve 28 is located on the lower side in the gravity direction in the region above the axial center of the developing sleeve 28. Thus, in this case, the developer drops from positions in a zone on the lower side in the gravity direction between the position of the local maximal peak (A) of the "r" component Br at the stripping magnetic pole N3 and the height position of the axial center of the developing sleeve 28 on the downstream side with respect to the position of the local maximal peak (A). Therefore, when the third conveying screw 31 is arranged correspondingly to this region so that the dropped developer is accurately guided onto the third conveying screw 31, an advantage of the present invention can be obtained.

Figure 7:
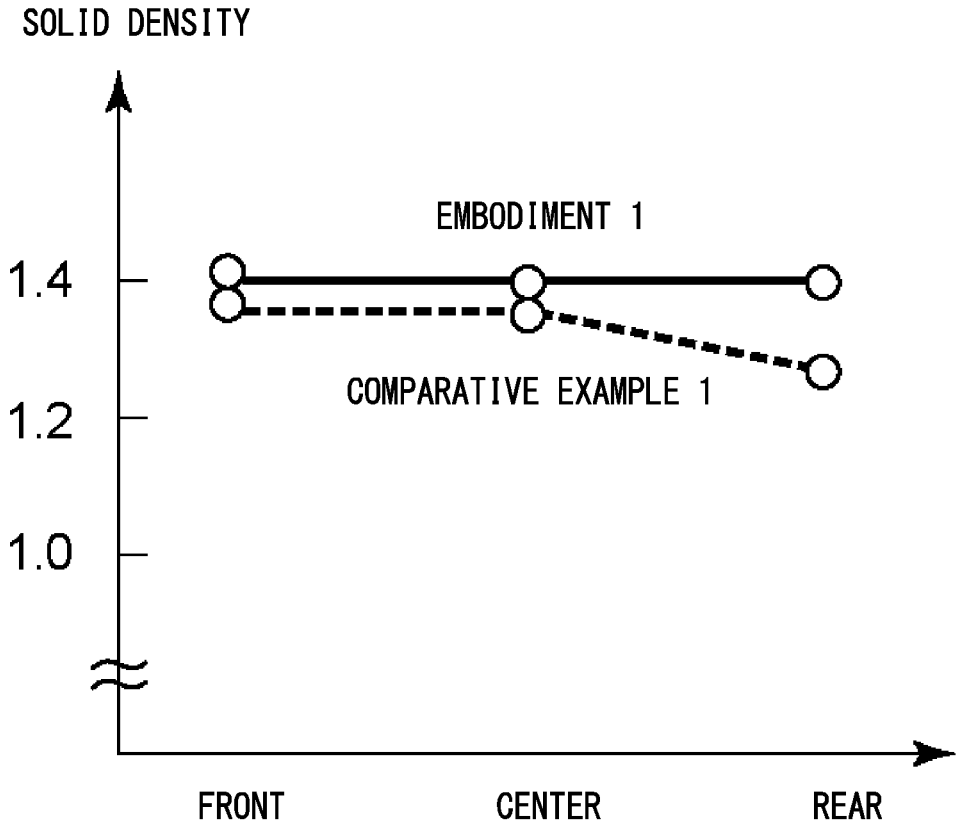
FIG. 7 is a graph showing measurement results of a solid density of a developing apparatus according to the embodiment of the present invention and a solid density of a developing apparatus according to a comparative example.
Figure 8:
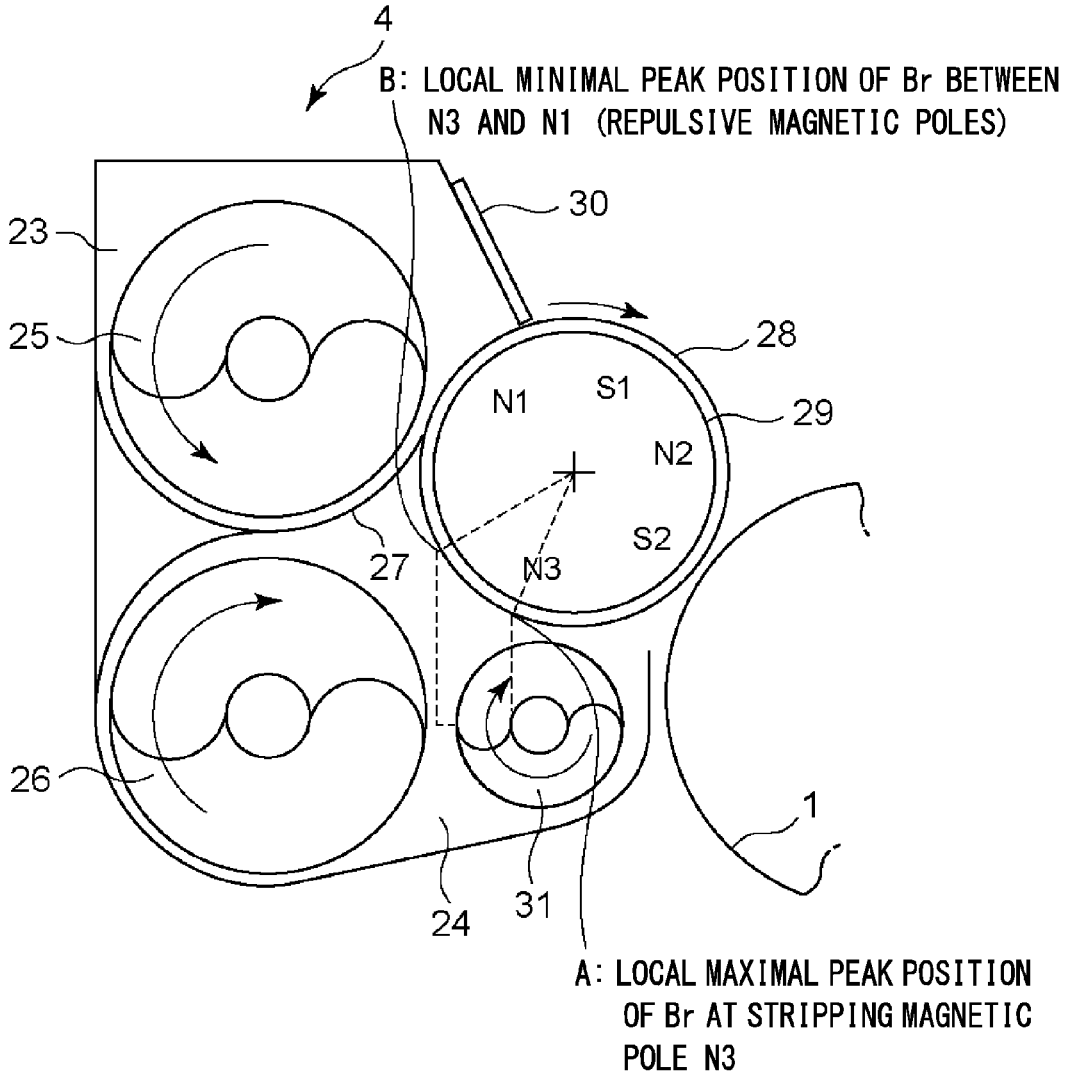
FIG. 8 is an explanatory diagram of the developing apparatus according to the comparative example.

FIG. 7 shows results of measurements of an image density at three points of a front, a center, and a rear on the 10th solid black image of 10 solid black images successively developed by the developing apparatus structured as described above. As shown in FIG. 7, the image density was substantially uniform among all the positions in the axial direction of the developing sleeve 28. FIG. 7 also shows, as a comparative example, results of similar measurements of another image density developed by a developing apparatus illustrated in FIG. 8. The another image density slightly decreased at the rear close to a communication portion communicating the collection chamber (agitating chamber) to the supply chamber (developing chamber), with the result that non-uniformity of the another image density occurred. This is because, in the developing apparatus 4 illustrated in FIG. 8, a part of the developer stripped off and dropped from the developing sleeve 28 is supplied directly onto the second conveying screw 26 without dropping onto the third conveying screw 31. In other words, the developer collected from the developing sleeve 28 is conveyed immediately to the supply chamber without being sufficiently agitated, and then resupplied to the developing sleeve 28.

As is understood from the above description, when the structure of the present invention is employed, the developer collected from the developing sleeve is no longer conveyed immediately to the supply chamber without being sufficiently agitated, and occurrence of non-uniformity of the image density can be prevented even when copying is successively performed.

In the example described above in this embodiment, as illustrated in FIG. 4A, the center of a rotary shaft of the third conveying screw 31 is set on the lower side in the gravity direction with respect to the zone AB, and the entire region of the zone AB falls within the range corresponding to the outer diameter of the third conveying screw 31 in the gravity direction. However, as long as at least one of those configurations is employed, the collected developer can be agitated with higher efficiency, and the level of the developer can be equalized while suppressing partial decrease of the toner density. In other words, even when the center of the rotary shaft of the third conveying screw 31 does not fall within a range on the lower side in the gravity direction with respect to the zone AB, the advantage of the present invention can be obtained as long as at least the entire zone AB falls within the range corresponding to the outer diameter of the third conveying screw 31 in the gravity direction. Alternatively, even when the entire zone AB does not fall within the range corresponding to the outer diameter of the third conveying screw 31 in the gravity direction, the advantage of the present invention can be obtained as long as at least the center of the rotary shaft of the third conveying screw 31 is set within the region on the lower side in the gravity direction with respect to the zone AB.

(Embodiment 2)

Embodiment 2 of the present invention is the same as Embodiment 1 above except the following matters. Thus, in the description of Embodiment 2, the same components as the components in Embodiment 1 above are denoted by the same reference symbols, and detailed description thereof is omitted.

Figure 9:
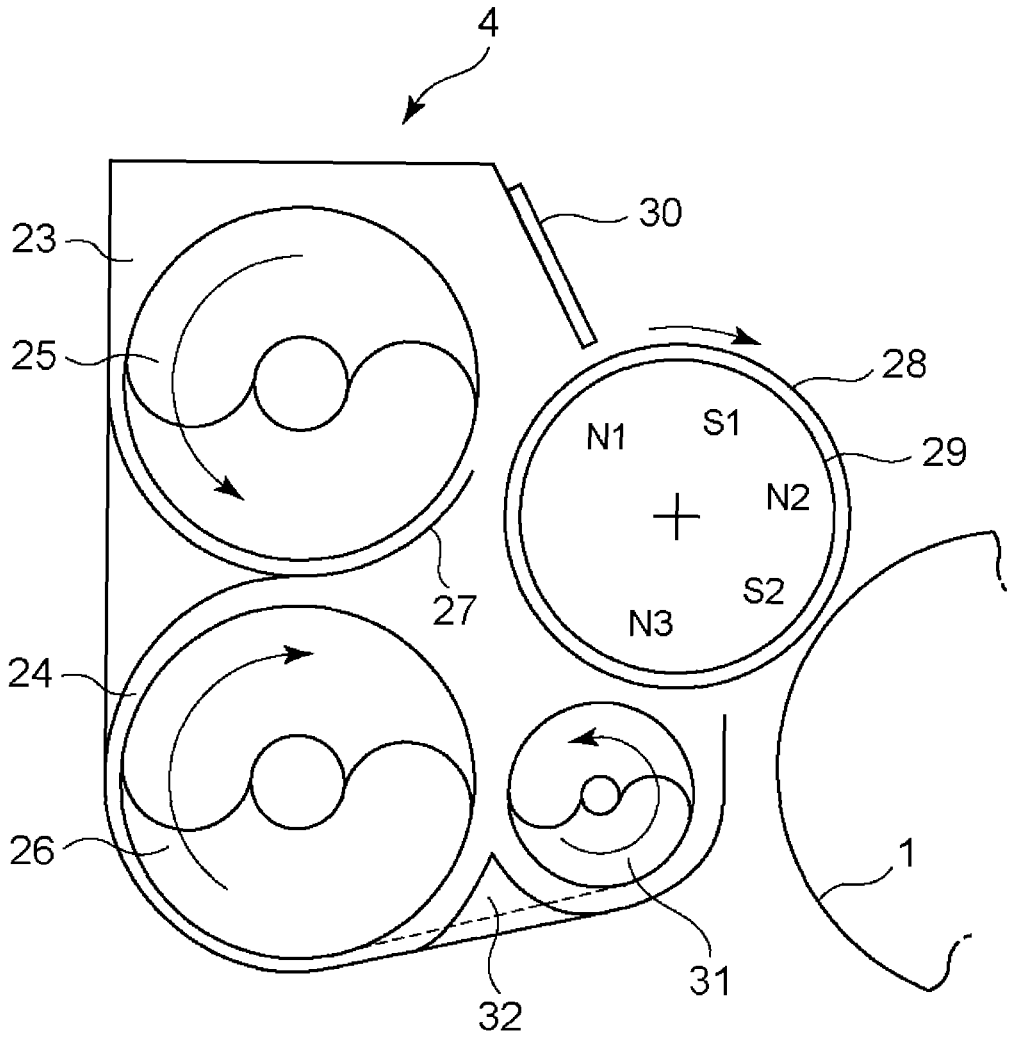
FIG. 9 is an explanatory diagram of a developing apparatus according to another embodiment of the present invention.

As illustrated in FIG. 9, although Embodiment 2 is substantially the same as Embodiment 1, Embodiment 2 has a feature of further including a protrusion 32 provided between the second conveying screw 26 and the third conveying screw 31 of the collection chamber 24.

This protrusion 32 is arranged to protrude beyond a line gently connecting a lower end of the second conveying screw 26 and a lower end of the third conveying screw 31 to each other (broken line in FIG. 9). The protrusion 32 thus provided has a function to hinder the developer, which is collected from the developing sleeve 28 onto the third conveying screw 31, from being immediately conveyed toward the second conveying screw 26. Thus, the developer collected from the developing sleeve 28 can be more reliably prevented from being immediately conveyed to the second conveying screw 26.

Note that, as illustrated in FIG. 9, the third conveying screw 31 in this case is rotated counterclockwise. This is because, when the blade of the third conveying screw 31 is rotated in a direction in which the third conveying screw 31 is spaced apart from the second conveying screw 26 near a bottom surface on which the developer is liable to stagnate, the developer collected from the developing sleeve 28 is much more reliably prevented from being immediately conveyed to the second conveying screw 26.

Further, in this case, a height of the protrusion is preferred to be lower than a height of the axial center of the third conveying screw 31 (broken line in FIG. 9). This is because, when the developer is moved only from an upper half of the third conveying screw 31 to the second conveying screw 26, more than half of the third conveying screw 31 is immersed with the developer. In this case, the developer dropped from the developing sleeve 28 cannot be effectively agitated and mixed with the developer on the bottom portion of the third conveying screw 31. In such a state, the developer dropped from the developing sleeve 28 is more liable to be supplied to the second conveying screw 26 while passing through only an upper side of the third conveying screw 31 without being sufficiently agitated by the third conveying screw 31. In particular, as in this embodiment, when the blade of the third conveying screw 31 in the upper half with respect to the axial center thereof is spirally rotated toward the second conveying screw 26, the problem described above is liable to be more conspicuous. Therefore, the height of the protrusion 32 is preferred to be lower than the height of the axial center of the third conveying screw 31.

(Embodiment 3)

Embodiment 3 of the present invention is the same as Embodiment 1 above except that Embodiment 3 is different from Embodiments 1 and 2 in the following matters. Thus, in the description of Embodiment 3, the same components as the components in Embodiment 1 above are denoted by the same reference symbols, and detailed description thereof is omitted.

Figure 10:
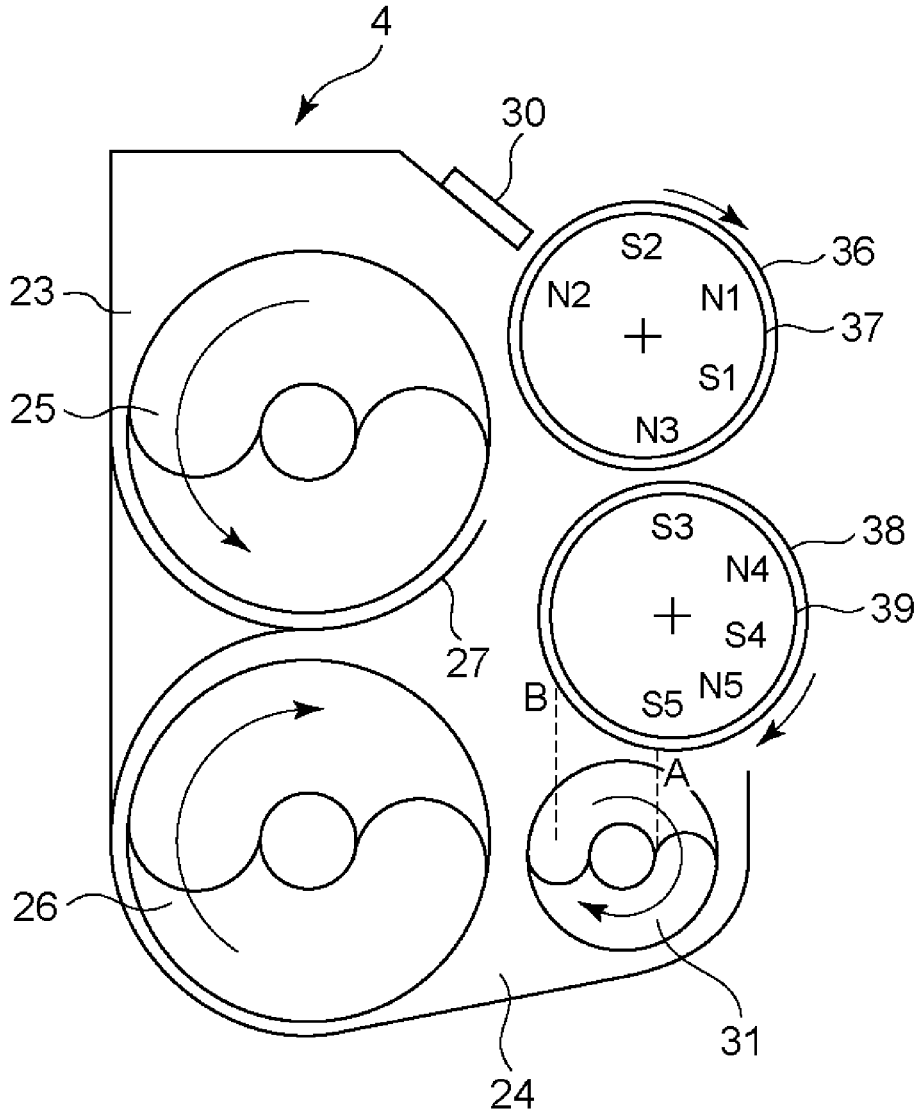
FIG. 10 is an explanatory diagram of a developing apparatus according to still another embodiment of the present invention.
Figure 11:
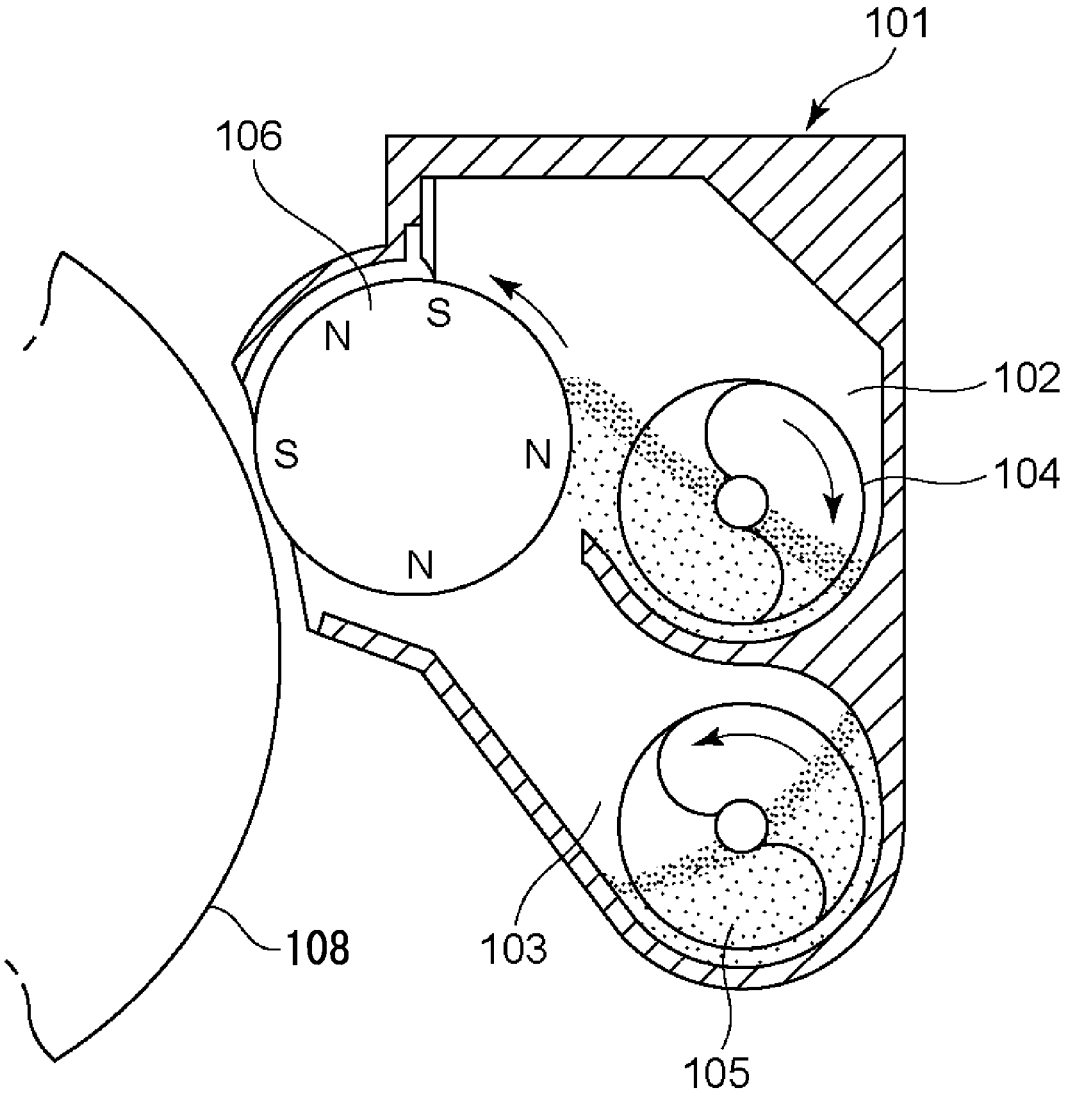
FIG. 11 (PRIOR ART)
FIG. 11 is an explanatory diagram of a conventional developing apparatus.
Figure 12:
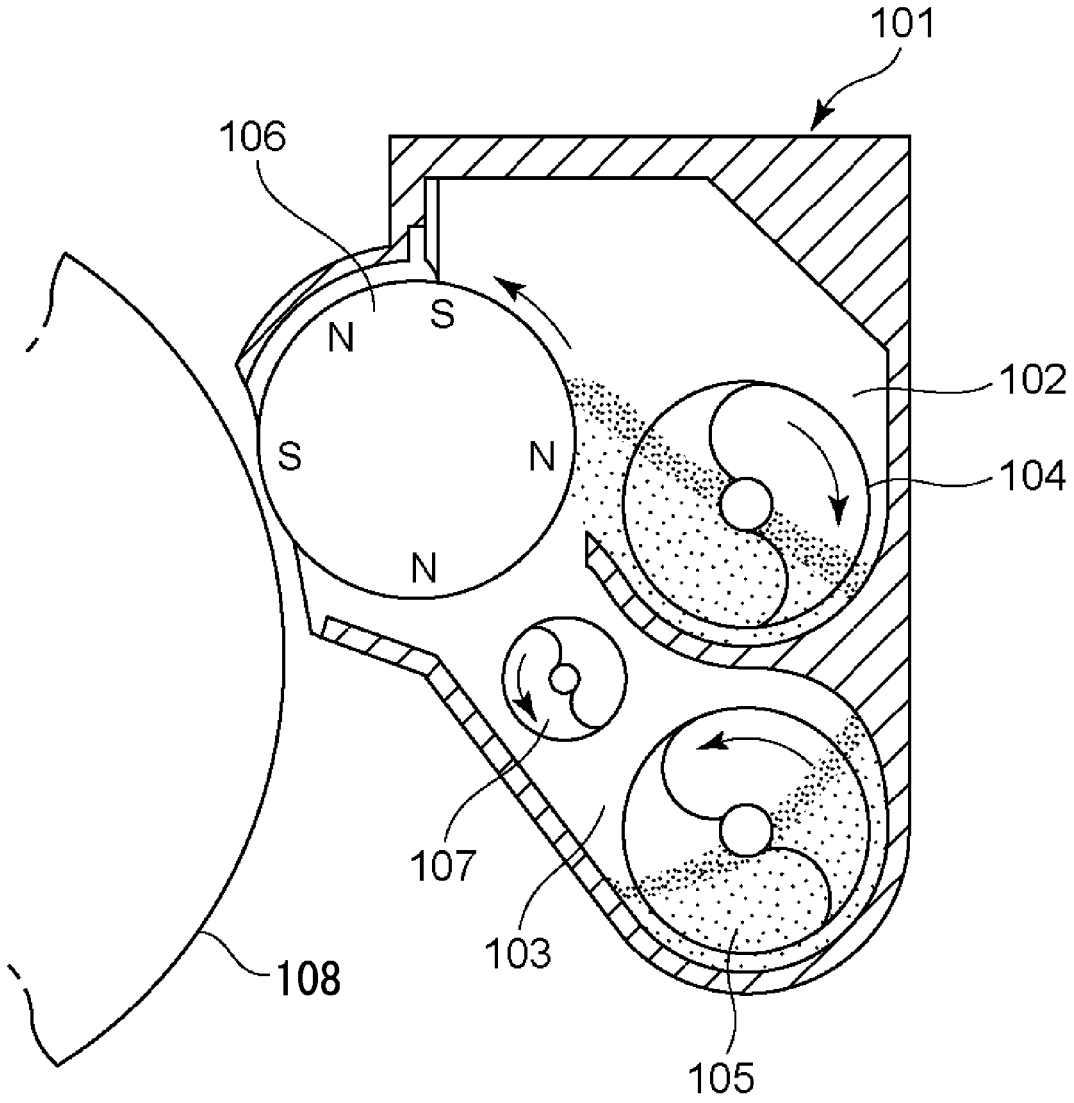
FIG. 12 (PRIOR ART)
FIG. 12 is an explanatory diagram of another conventional developing apparatus.

Although Embodiment 3 is substantially the same as Embodiment 1, as illustrated in FIG. 10, Embodiment 3 has a feature of including two upstream and downstream developing sleeves 36 and 38 respectively surrounding unrotatable magnet rollers 37 and 39.

In the developing apparatus 4 according to this embodiment, the developer supplied from the supply chamber 23 to the upstream developing sleeve 36 is transferred to the downstream developing sleeve 38. The developer transferred to the downstream developing sleeve 38 starts to be stripped off from a position of a local maximal peak (A) of an "r" component Br of an upstream stripping magnetic pole S5 as a repulsive magnetic pole, of a plurality of magnetic poles of the magnet roller 39 in the downstream developing sleeve 38, into the collection chamber 24. After that, stripping off of the developer is completed between the stripping magnetic pole S5 and a local minimal peak (B) of an "r" component Br at a magnetic pole S3 arranged on the downstream side with respect to the stripping magnetic pole S5 and having the same polarity as that of the stripping magnetic pole S5. Therefore, the advantage of the present invention can be obtained by arranging the third conveying screw 31 immediately on the lower side in the gravity direction with respect to a zone between the position of the local maximal peak (A) of the "r" component Br of the magnetic flux density of the stripping magnetic pole S5 of the downstream developing sleeve 38 and a position of the local minimal peak (B) of the "r" component Br between repulsive magnetic poles.

As in this embodiment, also when the plurality of developing sleeves are provided, the advantage of the present invention can be obtained by arranging, in the same way as that in Embodiment 1, the third conveying screw 31 with respect to the developing sleeves arranged on the end of the downstream side in the developer conveying direction.

Note that, in the case described in this embodiment, the supply chamber and the collection chamber are arranged at the upper and lower positions in the gravity direction, but the present invention is not limited thereto. For example, the present invention is applicable also to a structure in which the supply chamber and the collection chamber are arranged in a horizontal direction.

According to the present invention, it is possible to provide a developing apparatus configured to efficiently agitate the collected developer and the developer subjected to toner replenishment while suppressing the rise of the level of the developer on the downstream side in the developer conveying direction in the collection chamber configured to collect the developer from the developer carrying member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-058902, filed Mar. 15, 2012, which is hereby incorporated by reference herein in its entirety.

What is claimed is:

1. A developing apparatus, comprising:

a developer carrying member provided in a rotatable manner and configured to carry a developer including a toner and a carrier to develop an electrostatic latent image;

a magnet fixedly disposed inside the developer carrying member and configured to cause the developer carrying member to carry the developer on a surface of the developer carrying member, the magnet including a first magnetic pole and a second magnetic pole disposed downstream of the first magnetic pole in a rotation direction of the developer carrying member and having the same polarity as a polarity of the first magnetic pole to form a repulsive magnetic field between the first magnetic pole and the second magnetic pole;

a developing chamber disposed opposite to the developer carrying member and configured to supply the developer to the developer carrying member;

a collection chamber configured to form a circulation route for circulating the developer with the developing chamber and configured to collect the developer from the developer carrying member;

a first screw disposed in a rotatable manner in the developing chamber and configured to convey the developer in the developing chamber;

a second screw disposed in a rotatable manner in the collection chamber and configured to convey the developer in the collection chamber in a direction opposite to the first screw;

a third screw disposed in a rotatable manner in the collection chamber and configured to convey the developer in the collection chamber in a direction opposite to the second screw; and a protrusion provided on a bottom surface of the collection chamber between the second screw and the third screw, with a top of the protrusion being lower than a rotation center of the third screw, wherein the second screw and the third screw are disposed opposite to each other without a partition wall therebetween, and the developer is free to move directly from the third screw to the second screw, and wherein a first position is a position of a local maximal peak of a component, in a normal direction of the developer carrying member, of a magnetic flux density, on the surface of the developer carrying member, of the first magnetic pole, a second position is a position of a local minimal peak of the component, in the normal direction of the developer carrying member, of the magnetic flux density, on the surface of the developer carrying member, of the magnet, the position of the local minimal peak being located immediately downstream of the first position in the rotation direction of the developer carrying member, and the rotation center of the third screw is disposed in a projection area on which an area of the surface of the developer carrying member downstream of the first position in the rotation direction of the developer carrying member and upstream of the second position in the rotation direction of the developer carrying member is projected downward in a gravity direction in a cross section orthogonal to a rotation axis of the third screw.

2. The developing apparatus according to claim 1, wherein in the cross section orthogonal to the rotation axis of the third screw, a horizontal width of the projection area is smaller than a horizontal width of a locus drawn by the third screw as the third screw is rotated, and an entirety of the projection area is disposed within an area of the locus.

3. The developing apparatus according to claim 1, wherein the first magnetic pole is disposed below a rotation center of the developer carrying member in the gravity direction.

* * * * *